US005251448A

United States Patent [19]

Rodger

[11] Patent Number: 5,251,448

[45] Date of Patent: Oct. 12, 1993

[54] HEAT MACHINE

[75] Inventor: Keith P. Rodger, West Midlands, England

[73] Assignee: Lucas Industries, public limited company, West Midlands, England

[21] Appl. No.: 848,922

[22] Filed: Mar. 10, 1992

[30] Foreign Application Priority Data

Mar. 16, 1991 [GB] United Kingdom ..... 9105593

[51] Int. Cl.[5] ..... F25B 9/00; F25B 9/14

[52] U.S. Cl. ..... 62/6; 60/520; 250/352

[58] Field of Search ..... 62/6; 60/520; 250/352

[56] References Cited

U.S. PATENT DOCUMENTS

| | | | |
|---|---|---|---|
| 2,907,169 | 10/1959 | Newton | 62/6 X |
| 3,218,815 | 11/1965 | Chellis et al. | 62/6 |
| 3,333,433 | 8/1967 | Chellis | 62/6 |
| 3,650,118 | 3/1972 | O'Neil | 62/6 |
| 4,090,859 | 5/1978 | Hanson . | |
| 4,206,609 | 6/1980 | Durenec . | |
| 4,245,477 | 1/1981 | Glode et al. | 62/6 |
| 4,425,764 | 1/1984 | Lam | 62/6 |
| 4,479,358 | 10/1984 | Lam . | |
| 5,056,317 | 10/1991 | Stetson | 62/6 |

FOREIGN PATENT DOCUMENTS

| | | | |
|---|---|---|---|
| 4-3857 | 1/1992 | Japan | 62/6 |
| WO83/03297 | 9/1983 | PCT Int'l Appl. . | |
| 559077 | 5/1977 | U.S.S.R. | 62/6 |
| 1028968 | 7/1983 | U.S.S.R. | 62/6 |
| 772753 | 4/1957 | United Kingdom . | |
| 2152201 | 7/1985 | United Kingdom | 62/6 |

*Primary Examiner*—Albert J. Makay
*Assistant Examiner*—Christopher B. Kilner
*Attorney, Agent, or Firm*—Staas & Halsey

[57] ABSTRACT

A heat machine comprising a displacer reciprocating within a housing. The displacer incorporates first and second independent, co-axial, overlapping regenerators. A first working volume is formed between the displacer and the housing at a hot end of the heat machine. Second and third working volumes are formed between the displacer and the housing at a cold end of the heat machine. A partition separates the second and third working volumes. A gas flow path exists from the first working volume to the third working volume via the first regenerator, the second working volume, a gas path within the partition, and the second regenerator.

11 Claims, 2 Drawing Sheets

HEAT MACHINE

BACKGROUND OF THE INVENTION

1. Field of the Invention

The present invention relates to a heat machine. Such a heat machine may be used as a heat engine for converting heat to useful work or as a heat pump for moving heat from one place to another. For instance, such a heat pump may be used as a cooling or refrigeration apparatus based on the Stirling cycle.

2. Description of the Related Art

A known heat pump or "cryoengine" of the split Stirling cycle type is used for cooling an infra-red sensor to low temperatures, for instance of the order of several tens of degrees Kelvin. A "cold finger" is connected to a remote source of gas, such as helium, whose pressure is cyclically varied. The cold finger contains a displacer and heat regenerator which cool the tip of the finger, which tip is in contact with the sensing element of the infra red sensor.

In order to improve the efficiency of such heat pumps, it is known to provide a two-stage pump having two displacers and regenerators. For instance, U.S. Pat. No. 4090859 discloses a cold finger in which two displacers, each containing a heat regenerator, are arranged for free movement "in-line". However, such an arrangement creates problems in balancing the reciprocating movement of the two displacers, and requires a relatively complex construction.

U.S. Pat. No. 4425764 discloses an arrangement in which a first displacer is provided with an external heat regenerator and contains a second much smaller displacer which contains its own heat regenerator. This arrangement allows displacers of relatively low weight to be provided so as to reduce the reciprocating masses. However, two separate working gas feeds are required to the two displacers as the pressure variations required by the displacers are not in phase.

It is known to provide a two stage heat pump in which two displacers are fixed together but axially displaced from each other. However, this causes balancing problems because, in practice, the center of gravity of such an elongate displacer is located at a substantial distance from a spring suspension system for the displacer. Although counter-weights may be added to the displacer in order to move the center of gravity closer to the spring suspension, this increases the mass of the displacer, whose reciprocating motion therefore increases vibration of the cold finger. It is therefore more difficult to provide a stable mount for an infra-red sensor which is cooled by such a cold finger.

SUMMARY OF THE INVENTION

According to the invention, there is provided a heat machine comprising: a displacer arranged to reciprocate within a housing; a first regenerator; a second regenerator; a first working volume enclosed by a first end of the displacer and a first end of the housing; a second working volume enclosed between a second end of the displacer and a second end of the housing; a third working volume enclosed by the second end of the displacer and the second end of the housing; and a partition separating the second and third working volumes. Preferably the second working volume is annular. Preferably the third working volume is cylindrical. Preferably the second and third working volumes are concentric. Preferably the first regenerator is annular. Preferably the second regenerator is cylindrical. Preferably the first and second regenerators are co-axial and the first regenerator at least partially encloses the second regenerator.

Preferably the partition is cylindrical. Preferably the partition comprises first and second co-axial cylindrical walls spaced apart by an annular gap. Preferably the partition is arranged to provide gas communication between the first and second regenerators.

Preferably the third working volume communicates with the first working volume through the second regenerator, the second working volume, and the first regenerator.

Such a heat machine may be used as a heat pump, for instance as a cold finger for providing cooling of an infra-red sensor, to very low temperatures. Such an arrangement may form part of a heat pump arrangement in which a source of refrigerant gas, such as helium, of cyclically varying pressure is located remotely from the cold finger. The heat pump may be arranged to function in accordance with the Stirling cycle.

It is thus possible to provide a cold finger of the two-stage type having a displacer in which the center of gravity can be arranged to be sufficiently near a suspension so as to permit relatively easy balancing for movement. Such a cold finger is of relatively simple construction and can be used with an infra-red sensor without causing substantial problems in providing a stable mount therefor.

BRIEF DESCRIPTION OF THE DRAWINGS

The invention will be further described, by way of example, with reference to the accompanying drawings, in which.

DETAILED DESCRIPTION OF THE PREFERRED EMBODIMENT

Figure 1:
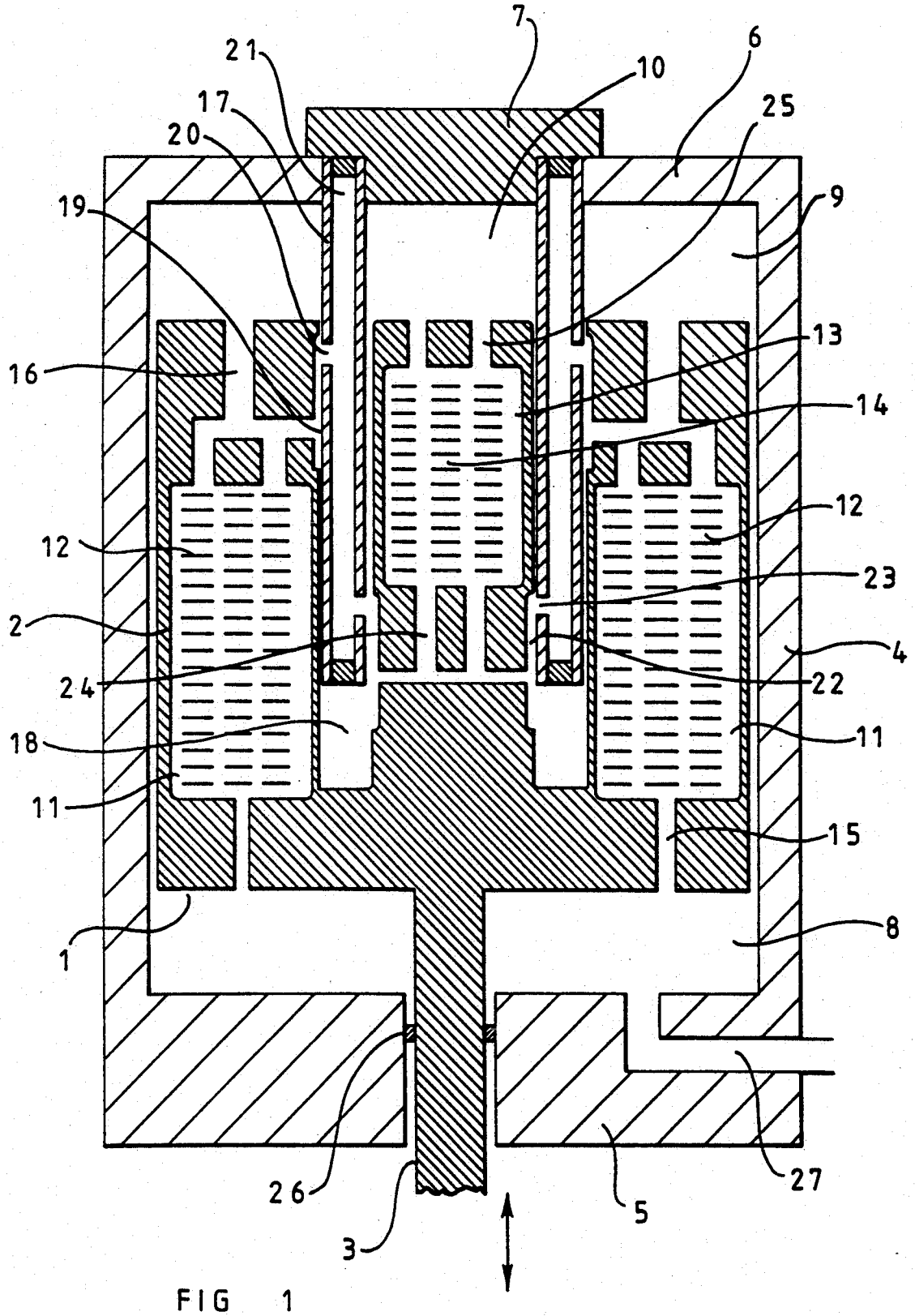
FIG. 1 is a cross-sectional view of a cold finger constituting an embodiment of the invention.

The cold finger shown in FIG. 1 comprises displacer 1 having a body 2 and a shaft 3, the body being enclosed by a housing 4. The housing may be made of titanium and has a first end 5 through which the shaft 3 passes and a second end 6. A heat transfer block 7, for instance made of copper, is fixed to the second end 6 so as to improve the thermal conductivity thereof.

A first working chamber 8 is provided at a "hot end" of the housing 4 whereas a second working chamber 9 and a third working chamber 10 are provided at a "cold end" of the housing 4. The body 2 contains a first chamber 11 containing a first regenerator 12 and a second chamber 13 containing a second regenerator 14. Channels 15 provide gas communication between the first working chamber 8 and the first regenerator 12. Channels 16 provide gas communication between the first regenerator 12 and the second working chamber 9.

A partition 17 extends from the second end 6 and separates the second working chamber 9 from the third working chamber 10. The partition 17 extends into an annular recess 18 in the body 2.

The partition 17 comprises cylindrical coaxial walls 19 and 22 which define a passageway 21 which is in continuous gas communication with the first regenerator 12 via a first set of apertures 20. The passageway 21 is also in continuous gas communication with the second regenerator 14 via a second set of apertures 23 and passageways 24. Passageways 25 provide gas communication between the second regenerator 14 and the third working chamber 10.

A gas tight seal 26 prevents the passage of a working gas, such as helium, between the shaft 3 and the first end 5.

The first end 5 is provided with a passageway 27 which communicates via tubing with a remote piston compressor. The cold finger and compressor (not shown) form a split Stirling cycle heat pump, the compressor providing pressure waves in the helium. A plurality of cold fingers may be connected to the same compressor.

The shaft 3 is connected to a drive arrangement, for instance of the electromagnetic type, and a suspension arrangement. When energised, the drive arrangement causes the displacer 1 to reciprocate with the reciprocating motion being controlled by the suspension which also prevents lateral movement of the shaft 3. For maximum efficiency, the resonant frequency of the suspension is made equal to the frequency of the reciprocating motion which, in turn, is equal to the frequency of the pressure waves in the helium but approximately 90° out of phase therewith.

Figure 2:
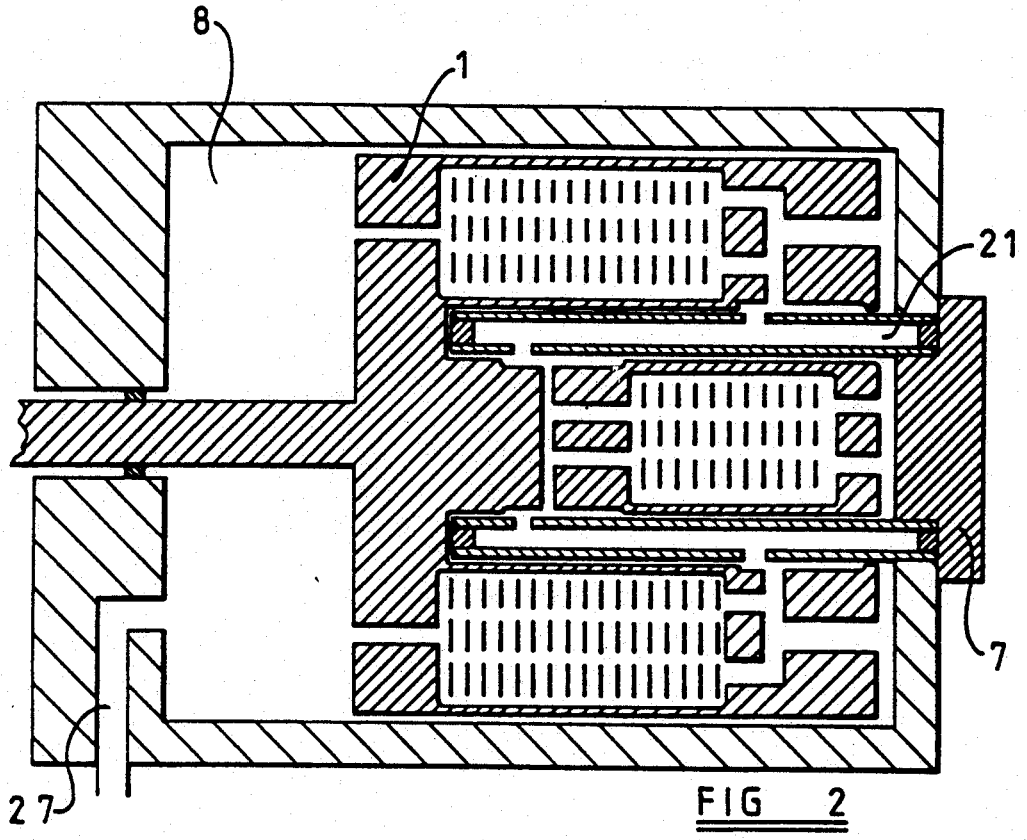
FIGS. 2 and 3 are cross-sectional diagrammatic views of the cold finger of FIG. 1 at different points of an operational, cycle thereof.
Figure 3:
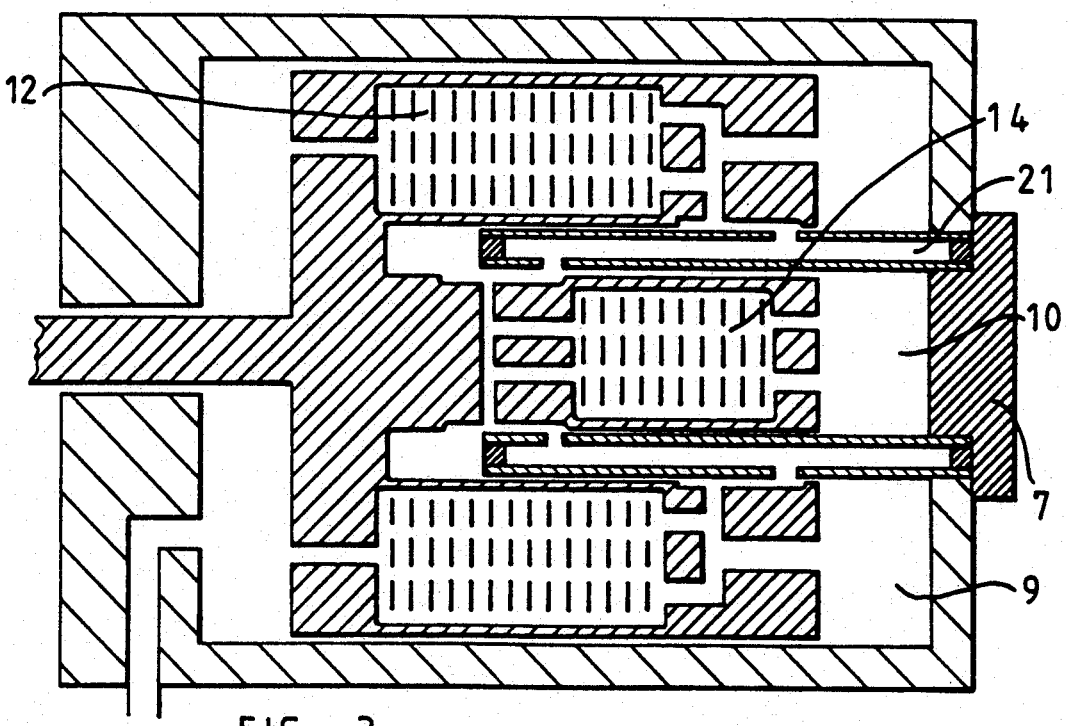

Operation of the cold finger is illustrated in FIGS. 2 and 3, and follows the basic reversed Stirling cycle. In FIG. 2, the displacer 1 is shown at a first end of its reciprocating motion, at its right hand most position in the drawing. In this position of the displacer, the compressor causes the pressure of the helium in the cold finger to be increased. The helium is thus compressed substantially isothermally and loses heat to the exterior via the first end 5. The displacer is then moved to the left until it reaches the position shown in FIG. 3, which represents the end of its first stroke of the cycle of operation. The helium is thus displaced through the first regenerator 12, with which it exchanges heat so as to be cooled to a temperature of about 60° Kelvin i.e. approximately −210° C. The cooled helium flows through the second regenerator 14 via the passage 21 where it is further cooled to about 30° Kelvin i.e. approximately −240° C., and passes into the third working chamber 10. Cooled helium from the first regenerator 12 also enters the second working chamber 9.

When the displacer reaches the end of its first stroke as shown in FIG. 3, the helium pressure is reduced by the compressor by isothermal expansion. The helium cools as it expands and is drawn from the third working chamber 10 through the second regenerator 14 into the second working chamber 9 and through the first regenerator 12 into the first working chamber 8. The displacer 1 then moves to the right so as to complete the second stroke of the cycle so that helium is displaced from the third working chamber 10 through the second regenerator 14 into the second working chamber 9 and through the first regenerator 12 into the first working chamber 8. Movement of the cooled helium through the first and second regenerators removes heat from the regenerators. Thus, as this cycle is repeated, heat passing from an infra-red sensor or the like via the heat transfer block 7 is removed in two stages so as to be dissipated to the exterior, due to the net reduction in helium gas temperature in the third working chamber 10 of about 30° Kelvin.

It is thus possible to provide a cold finger of the two stage split Stirling cycle type having a single gas pressure supply and a single displacer of relatively short length. The center of gravity of the displacer is thus not extended away from the suspension so that extra counter-balancing is not necessary and vibration is not a problem. The cold finger is of relatively simple construction and is easy and therefore cheaper to manufacture, while providing efficient cooling for infra-red sensors or other devices.

The partitions 17 and the passageway 21 act as a thermal barrier between the regenerators 12 and 14, so that the second stage is thermally isolated from the exterior, except at the heat transfer block 7, by the surrounding parts of the cold finger forming the first cooling stage.

I claim:

1. A heat machine comprising: a housing having first and second ends; a displacer having first and second ends, said displacer being reciprocable within said housing; a first regenerator; a second regenerator; and a partition, said first end of said housing and said first end of said displacer defining a first working volume, said second end of said housing and said second end of said displacer defining second and third working volumes, and said partition separating said second and third working volumes.

2. A heat machine as claimed in claim 1, in which said partition provides gas communication between said first and second regenerators.

3. A heat machine as claimed in claim 1, in which said second working volume is annular.

4. A heat machine as claimed in claim 3, in which said third working volume is cylindrical.

5. A heat machine as claimed in claim 4, in which said second and third working volumes are concentric.

6. A heat machine as claimed in claim 1, in which said first regenerator is annular.

7. A heat machine as claimed in claim 6, in which said second regenerator is cylindrical.

8. A heat machine as claimed in claim 7, in which said first and second regenerators are co-axial and said first regenerator at least partially encloses said second regenerator.

9. A heat machine as claimed in claim 1, in which said partition is cylindrical.

10. A heat machine as claimed in claim 9, in which said partition comprises first and second co-axial cylindrical walls defining therebetween an annular gap.

11. A heat machine as claimed in claim 1, in which said third working volume communicates with said first working volume through said second regenerator, said second working volume, and said first regenerator.

* * * * *